US007531220B2

(12) United States Patent
Madhava et al.

(10) Patent No.: US 7,531,220 B2
(45) Date of Patent: May 12, 2009

(54) METHOD FOR FORMING THICK QUASI-SINGLE PHASE AND SINGLE PHASE PLATINUM NICKEL ALUMINIDE COATINGS

(75) Inventors: Murali N. Madhava, Chicago, IL (US); George W. Reimer, Simpsonville, SC (US); Amol R. Gholkar, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 41 days.

(21) Appl. No.: 11/348,861

(22) Filed: Feb. 7, 2006

(65) Prior Publication Data

US 2007/0184305 A1 Aug. 9, 2007

(51) Int. Cl.

| | |
|---|---|
| ***B05D 3/00*** | (2006.01) |
| ***B05D 3/02*** | (2006.01) |
| ***B05D 3/04*** | (2006.01) |
| ***B05D 3/10*** | (2006.01) |

(52) U.S. Cl. ..... 427/405; 427/328; 427/383.7; 427/419.1

(58) Field of Classification Search ..... 427/383.1, 427/383.7, 405, 250, 419.1, 525, 328, 255.29
See application file for complete search history.

(56) References Cited

U.S. PATENT DOCUMENTS

| | | | | |
|---|---|---|---|---|
| 4,501,776 | A | 2/1985 | Shankar | |
| 5,494,704 | A | 2/1996 | Ackerman | |
| 6,022,632 | A | 2/2000 | Olson et al. | |
| 6,045,863 | A | 4/2000 | Olson et al. | |
| 6,129,991 | A | 10/2000 | Warnes et al. | |
| 6,136,451 | A | 10/2000 | Warnes et al. | |
| 6,206,973 | B1 | 3/2001 | Bailey et al. | |
| 6,291,014 | B1 * | 9/2001 | Warnes et al. | 427/252 |
| 6,589,668 | B1 | 7/2003 | Braithwaite et al. | |
| 2001/0053424 | A1 | 12/2001 | Schaeffer | |
| 2002/0037220 | A1 | 3/2002 | Saint Ramond et al. | |
| 2002/0187042 | A1 * | 12/2002 | Lee et al. | 416/97 R |
| 2003/0116237 | A1 | 6/2003 | Worthing, Jr. et al. | |
| 2004/0028938 | A1 | 2/2004 | Saint Ramond et al. | |
| 2005/0003227 | A1 | 1/2005 | Khan et al. | |
| 2005/0069642 | A1 | 3/2005 | Purvis et al. | |
| 2005/0145503 | A1 | 7/2005 | Kozlov et al. | |
| 2005/0147840 | A1 | 7/2005 | Spitsberg | |

* cited by examiner

*Primary Examiner*—Michael La Villa
(74) *Attorney, Agent, or Firm*—Ingrassia, Fisher & Lorenz, P.C.

(57) ABSTRACT

A quasi-single phase or single phase thick platinum nickel aluminide coating and methods for forming the coating over a nickel-based superalloy substrate are provided. The method includes the steps of forming a metal layer over a surface of the nickel-based superalloy substrate, the metal layer comprising platinum, growing a diffusion zone comprising a platinum nickel alloy layer from the metal layer and the nickel-based superalloy substrate, and subjecting the platinum nickel alloy to one or more aluminization cycles to transform the platinum nickel alloy into a platinum nickel aluminide coating having a platinum aluminide phase formed therein.

14 Claims, 14 Drawing Sheets

METHOD FOR FORMING THICK QUASI-SINGLE PHASE AND SINGLE PHASE PLATINUM NICKEL ALUMINIDE COATINGS

TECHNICAL FIELD

The present invention relates to jet engines and, more particularly, to a method for forming a platinum nickel aluminide coating on a hot section component of the jet engine.

BACKGROUND

Turbine engines are used as the primary power source for various aircraft applications. The engines are also auxiliary power sources that drive air compressors, hydraulic pumps, and industrial gas turbine (IGT) power generation. Further, the power from turbine engines is used for stationary power supplies such as backup electrical generators for hospitals and the like.

Most turbine engines generally follow the same basic power generation process. Compressed air is mixed with fuel and burned, and the expanding hot combustion gases are directed against stationary turbine vanes in the engine. The vanes turn the high velocity gas flow partially sideways to impinge on the turbine blades mounted on a rotatable turbine disk. The force of the impinging gas causes the turbine disk to spin at high speed. Jet propulsion engines use the power created by the rotating turbine disk to draw more ambient air into the engine and the high velocity combustion gas is passed out of the gas turbine aft end to create forward thrust. Other engines use this power to turn one or more propellers, electrical generators, or other devices.

Since turbine engines provide power for many primary and secondary functions, it is important to optimize both the engine service life and the operating efficiency. Although hotter combustion gases typically produce more efficient engine operation, the high temperatures create an environment that promotes oxidation and corrosion. For this reason, many coatings and coating methods have been developed to increase the operating temperature limits and service lives of the high pressure turbine components, including the turbine blade and vane airfoils.

One category of conventional airfoil coatings includes platinum nickel aluminide coatings. These coatings may be applied onto surfaces of turbine blades, vanes, and other components to protect against oxidation and corrosion attack and are applied thereto by any one of a number of methods. Some methods include pack aluminide processing, chemical vapor deposition, electron beam physical vapor deposition, high velocity oxy-fuel, and low pressure plasma spray. These methods are often used in conjunction with additional complex procedures in order to transform the aluminide compositions to environment-resistant coatings. For example, a typical method for applying a platinum nickel aluminide coating to a substrate may include the steps of plating platinum on a nickel base superalloy substrate to a thickness of between about 4 μm and about 6 μm, heat-treating the plated platinum to form a diffused layer in the plated platinum, aluminizing the platinum diffused layer, and subsequently post coat diffusion heat-treating the aluminized platinum substrate.

Depending on the preferred microstructure and composition of the desired coating, the aluminizing step may include a high or low activity process. For example, in some cases, a dual or multi-phase coating having a thickness of between about 50 μm and 100 μm may be desired, and may be formed using a high activity process. Although these dual or multi-phase coatings are useful for many coating applications, they may be relatively brittle or less ductile due to particular constituents from the substrate that may extend into the coating. In such case, a ductile single phase (generally accepted phase of beta platinum nickel aluminide), relatively thin coating having a thickness of between about 35 μm to about 60 μm may be preferred, and a low activity process may be used. Although these aforementioned PtNiAl coatings are extensively used commercially, in certain circumstances, a substantially single phase coating having a thickness of about 75 μm or greater may alternatively be preferred. For example, thicker coatings may be preferred in instances in which improved service performance and an additional reservoir of protective material are needed. However, the production of these types of thicker coatings, for example, coating including thick single phase platinum nickel aluminides and quasi-single phase platinum aluminides of comparable characteristics, are relatively difficult to produce with conventional aluminization processes.

Hence, there is a need for improved methods for coating turbine engine components such as the turbine blades. There is a particular need for a method that produces a substantially single phase and/or quasi-single phase platinum nickel aluminide coating. The coatings formed using the improved methods preferably exhibit a thickness of greater than the about 60 μm.

BRIEF SUMMARY

The present invention provides a method for forming a thick quasi-single phase or single phase platinum nickel aluminide coating over a nickel-based superalloy substrate.

In one embodiment, and by way of example only, the method includes the steps of forming a metal layer over a surface of the nickel-based superalloy substrate, the metal layer comprising elements from the noble group of elements such as, platinum, growing a diffusion zone from the metal layer and the nickel-based superalloy substrate, the diffusion zone comprising a platinum nickel alloy containing some of the diffused elements from substrate, and subjecting the diffused zone to a one or more aluminization cycles to transform the platinum nickel alloy into platinum nickel aluminide alloy having at least one platinum aluminide phase formed therein.

In another embodiment, and by way of example only, a method for forming a quasi-single phase platinum nickel aluminide coating over a NiCrAlY substrate is provided. The method includes the steps of forming a metal layer over a surface of the NiCrAlY substrate, the metal layer comprising platinum, growing a diffusion zone from the metal layer and the NiCrAlY substrate, the diffusion zone comprising a platinum nickel alloy, and subjecting the platinum nickel alloy to a plurality of aluminization cycles to transform the platinum nickel alloy into a platinum nickel aluminide alloy having a platinum aluminide phase formed therein. The step of subjecting includes depositing aluminum over the platinum nickel alloy, and heating the deposited aluminum and the platinum nickel alloy.

In still another embodiment, and by way of example only, a turbine engine component is provided. The component includes a nickel-based superalloy substrate, a diffusion zone formed in the substrate with a noble metal, an additive layer formed from the diffusion zone, the additive layer comprising a platinum nickel aluminide alloy, and a platinum aluminide phase formed in the additive layer.

Other independent features and advantages of the preferred method will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
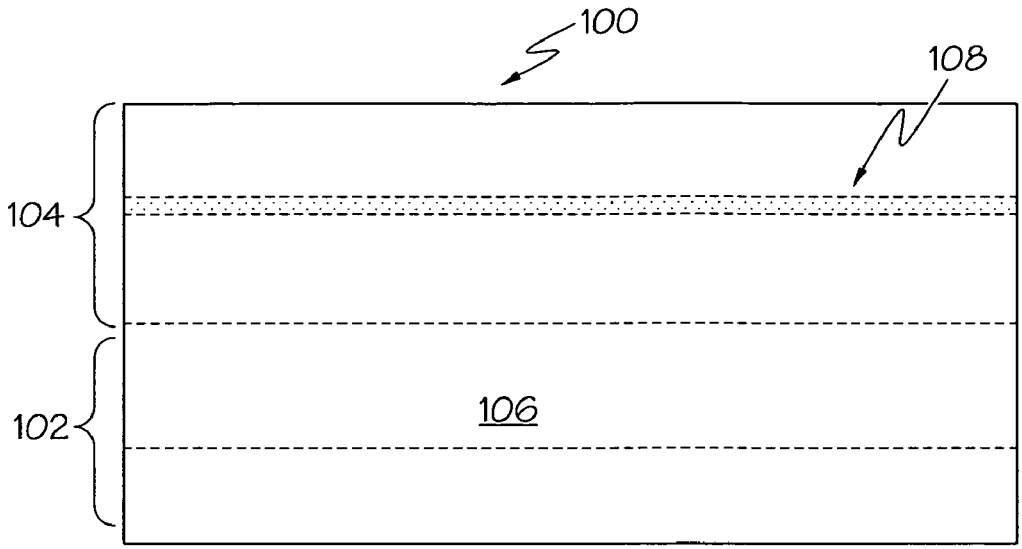
FIG. 1 is a schematic of an exemplary high pressure turbine component including an exemplary quasi-single phase coating formed thereon.
Figure 2:
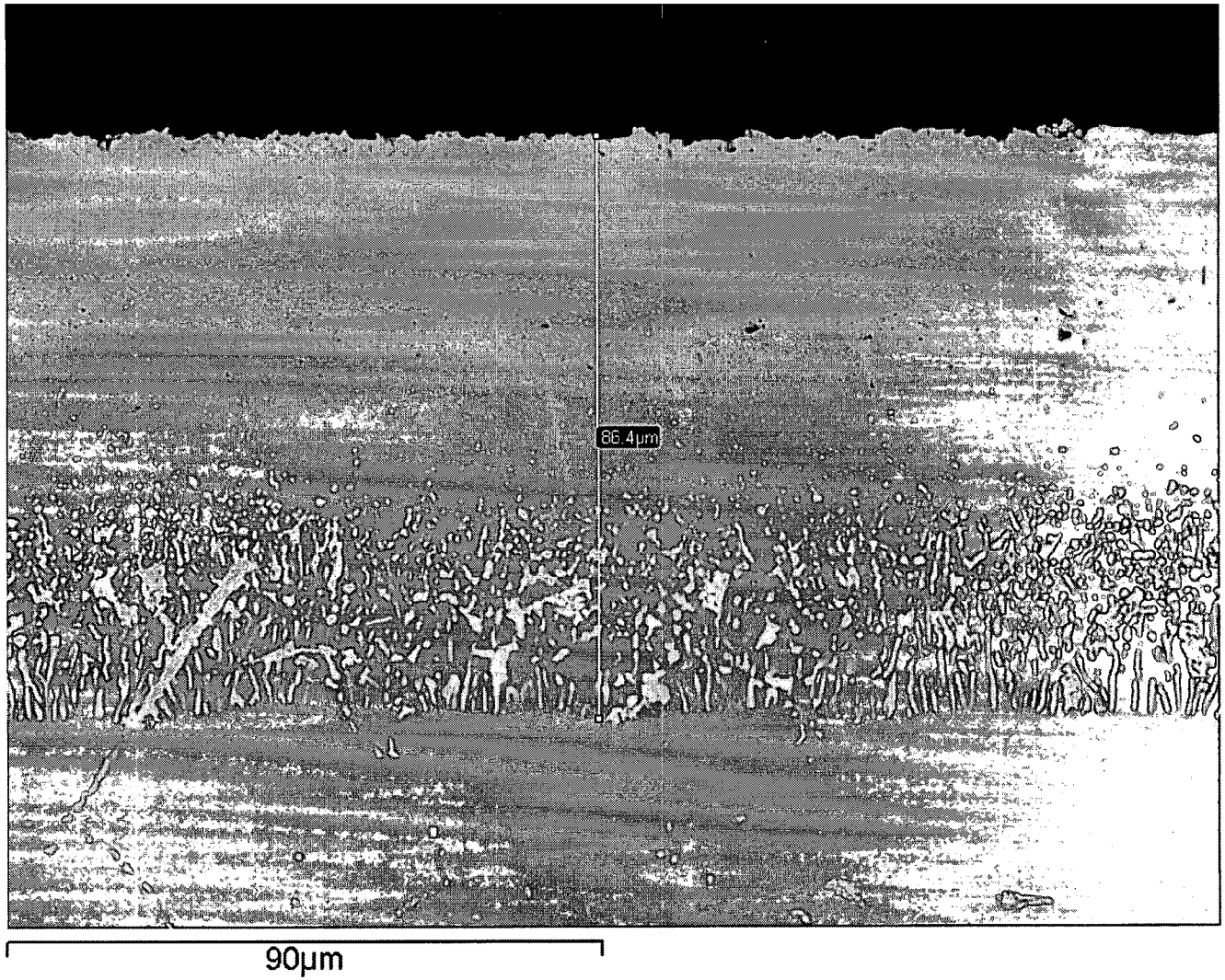
FIG. 2 is a representation of a quasi-single phase coating on MarM247 nickel base superalloy substrate.

Turning now to FIGS. 1 and 2, an exemplary high pressure turbine (HPT) component 100 including a substrate 102 and a quasi-single phase coating 104 formed thereon is depicted. The HPT component 100 may be any one of numerous engine components, such as turbine blades and vanes that may need protection from degradation due to corrosion, oxidation, sulfidation, thermal fatigue, and other hazards. The substrate 102 is preferably made from a high performance Ni-based superalloy such as IN738, IN792, MarM247, C101, Rene 80, Rene 125, Rene N5, SC 180, CMSX 4, and PWA 1484, or NiCrAlY.

At least a portion of the substrate 102 includes a diffusion zone 106 that comprises a Ni-based superalloy similar to the Ni-based superalloy of the component 100. Preferably, however, the diffusion zone 106 is partially depleted of nickel and may include, among other things, platinum. The diffusion zone 106 is adjacent the quasi-single phase coating 104. Each of the diffusion zone 106 and the quasi-single phase coating 104 may exhibit different thicknesses depending on preferred processing parameters.

The quasi-single phase coating 104 is preferably a corrosion resistant, oxidation resistant, sulfidation resistant coating made of a quasi-single phase coating and preferably makes up a thickness of greater than about 50 μm. Preferably, the quasi-single phase coating 104 comprises a single phase beta nickel platinum aluminide additive layer that includes a zone including platinum aluminide such as $PtAl_2$ or a band 108 that is formed substantially in the single phase beta NiPtAl additive layer. It will be appreciated that although certain preferred alloys are mentioned herein as being useful for forming the quasi-single phase coating 104, it will be appreciated that these alloys may include trace elements, such as Hf, Ta, or W, which during processing can diffuse into the quasi-single phase coating 104 from the substrate 102 and, thus may influence the protective properties of the quasi-single phase coating 104.

Figure 3:
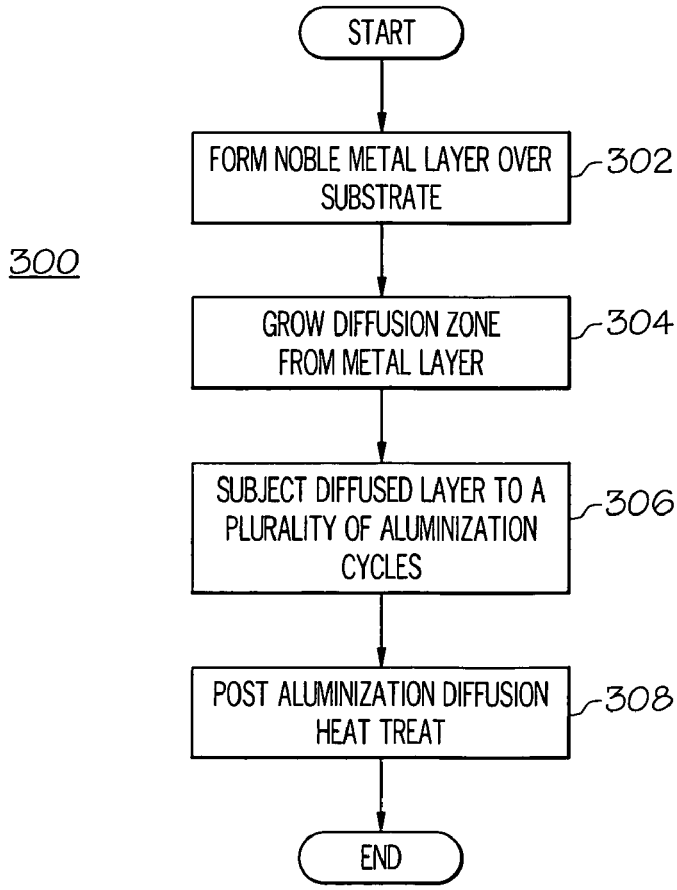
FIG. 3 is a flow diagram of an exemplary method for producing the quasi-single phase coating.

One exemplary method 300 for forming the quasi-single phase coating 104 is depicted in FIG. 3. In this embodiment, first, a noble metal layer is formed over the substrate 102, step 302. Then, the noble metal is diffused into the substrate 102 to form a diffused layer, step 304. The diffused layer is then subjected to a plurality of aluminization cycles and post coat heat treatments and transformed into the quasi-single phase coating 104, steps 306 and 308.

Figure 4:
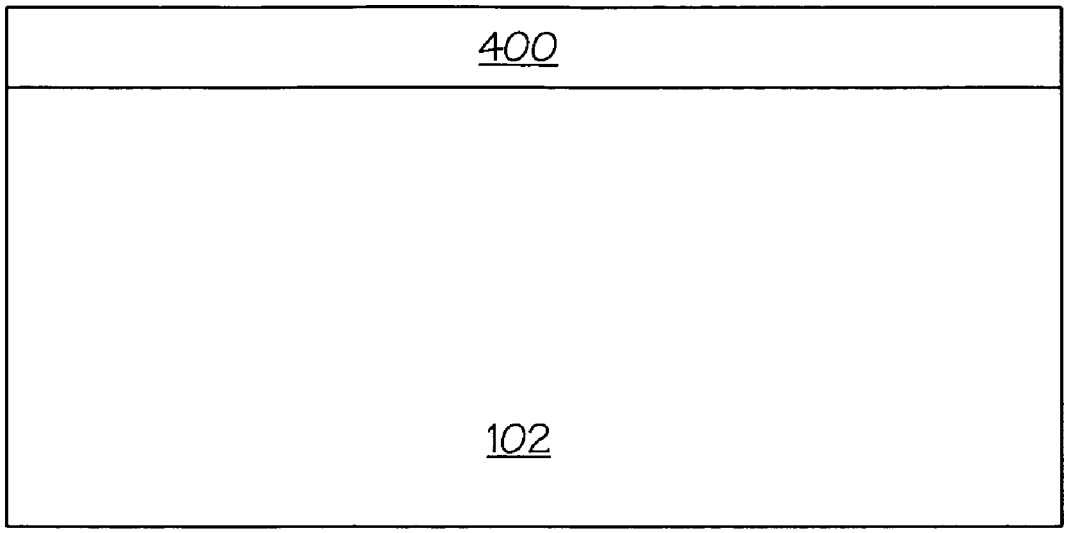
FIG. 4 is a cross section of an exemplary component during a step of the coating method depicted in FIG. 3.

As briefly mentioned above and as shown in FIG. 4, a noble metal layer 400 is first formed over the substrate 102, step 302. Preferably, the noble metal layer 400 is made substantially of platinum, but may alternatively include any one of numerous other precious metals, such as, for example, palladium, rhodium, and iridium. Additionally, the noble metal layer 400 is deposited over the substrate 102 such that it has a substantially uniform thickness. Preferably, the noble metal layer 400 has a thickness of between about 6 μm and about 15 μm.

It will be appreciated that the noble metal layer 400 may be formed over the substrate 102 using any one of numerous conventional techniques. In one exemplary embodiment, the noble metal layer 400 is electroplated onto the substrate 102 using a basic bath. Here, an electrolyte containing il a desired thickness is achieved. In another embodiment, the noble mthe platinum salt composition may be agitated or sonicated to maintain the platinum salt in suspension either before and/or during electroplating. The substrate 102 is at least partially submerged into the electrolyte composition with an anode and acts as a cathode when a voltage is supplied thereto. Electroplating continues untetal layer 400 is deposited over the substrate 102. For example, the noble metal layer 400 may be deposited by chemical vapor deposition, physical vapor deposition, plasma deposition, or sputtering.

Figure 5:
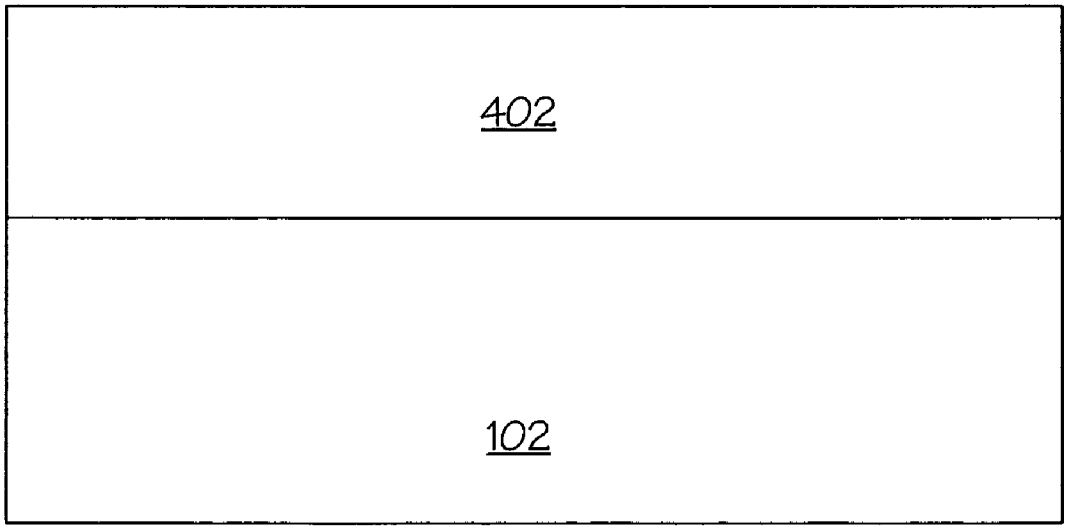
FIG. 5 is a cross section of an exemplary component during another step of the coating method depicted in FIG. 3.

As shown in FIG. 5, after the noble metal layer 400 is formed, a diffusion zone 402 is grown therefrom, step 304. Specifically, a portion of the noble metal layer 400 is diffused into the substrate 102. In this regard, the noble metal layer 400 and substrate 102 are subjected to a thermal diffusion treatment. The thermal treatment may be applied in a high temperature furnace using a vacuum or an inert or other protective gas to avoid oxidation. One exemplary thermal diffusion treatment is performed in an inert atmosphere or under vacuum, with controlled temperature ramps to reach diffusion temperatures of between about 1025° C. and about 1150° C. for between about 1 and about 4 hours.

Next, the diffusion zone 402 is exposed to a plurality of aluminization and post coat heat treatment diffusion cycles, step 306 and step 308. The initial aluminization cycle causes aluminum to diffuse into the diffusion zone 402 and allows for the formation of an additive layer which will result in the quasi-single phase coating 104. Preferably, a "low" to "intermediate" activity aluminization process is employed. In this regard, the diffusion zone 402 is preferably processed at a temperature that is preferably between about 1025° C. to about 1150° C. for a duration of between about 1 and about 10 hours. The aluminization process may be an out of pack vapor phase process or an in pack process.

The aluminization cycle is preferably followed by a post coat heat treatment diffusion cycle. The post coat heat treatment diffusion cycle can be applied in a similar manner as step 304, and may be performed at a temperature in a range of between about 1050° C. to about 1150° C. for a period of between about 2 to about 6 hours. Preferably, the aluminization and post coat diffusion heat treatment cycle are repeated as needed. The total number of aluminization cycles depends on the desired thickness of the additive layer. For example, second and possibly third aluminization cycles may be employed to add to the additive layer to thicken the resultant quasi-single phase coating 104. During the additional aluminization cycles, some platinum, aluminum and nickel are redistributed in the additive layer to form a finely dispersed platinum aluminide zone 108, in the quasi-single phase coating 104. The platinum aluminide zone 108 may have a thickness of between about 6 μm and about 12 μm and may comprise $PtAl_2$.

In one exemplary embodiment, a plurality of aluminization cycles is used to develop a thick platinum aluminide coating. For example, two additional aluminization and post coat heat treatment cycles may be used to treat a noble metal layer 400 having about a thickness of about 12 μm to produce a resulting quasi-single phase coating 104 having a thickness of greater than about 100 μm.

Experiments were performed to obtain results for comparing a thin single phase beta platinum nickel aluminide coating and four different types of thick platinum aluminide coatings made largely in accordance with the method described above. These experiments are summarized in Table I and are described in detail below.

TABLE I

| | | | | COATING CHEMISTRY (MAJOR ELEMENTS) | | |
|---|---|---|---|---|---|---|
| COATING | PROCESS | CYCLE | MILS | Al | Cr | Co |
| Normal | a) 6 μm Pt Plate | Electroplate | — | — | — | — |
| Standard | b) Pt diffusion | 1900° F./90 min., Vacuum | 0.5 | — | — | — |
| PtNiAl, Thin | c) Aluminizing | 1975° F./85 min., Vacuum with partial pressure of argon gas | 1.9 | 27.8 | 2.8 | 3.8 |
| | d) Post coat diffusion | 1950° F./3 hours | 2.2-2.6 | 21.1 | 1.8 | 5.3 |
| Thick PtNiAl | a) 9 μm Pt plate | Electroplate | — | — | — | — |
| coating 'A' | b) Pt diffusion | 2000° F./4 hours, Vacuum | 1.24 | — | — | — |
| | c) Aluminizing | 1975° F./85 min. Vacuum with partial pressure of argon gas | 2.1 | 25.86 | 1.67 | 3.33 |
| | d) post coating diffusion | 2000° F./4 hours | 3.1 | 18.69 | 2.34 | 4.77 |
| Thick, PtNiAl | a) 12 μm Pt plate | Electroplate | — | — | — | — |
| coating 'B' | b) Pt diffusion | 2025° F./4 hours, Vacuum | 1.5 | — | — | — |
| | c) Aluminizing | 1975° F./85 min. Vacuum with partial pressure of argon gas | 2.7 | 27.1 | 2.4 | 3.2 |
| | d) post coating diffusion | 2025° F./4 hours | 3.4 | 19.5 | 1.4 | 4.3 |
| Thick, PtNiAl | a) 12 μm Pt plate | Electroplate | — | — | — | — |
| coating 'C' | b) Pt diffusion | 1975° F./4 hours, Vacuum | 1.1 | — | — | — |
| | c) First cycle Aluminizing | 1975° F./85 min. vacuum with argon partial pressure | 2.0 | 27.7 | 1.5 | 3.3 |
| | d) Post coat diffusion | 1950° F./3 hours | 2.2 | 20.5 | 1.8 | 4.3 |
| | e) Two more aluminization cycles and heat treat cycles | Aluminization cycles at 1975° F./85 min. vacuum Post coat diffusion heat treats at 1950° F./3 hours | 4 | 26.3 | 1.3 | 3.6 |

| | | COATING CHEMISTRY (MAJOR ELEMENTS) | | | |
|---|---|---|---|---|---|
| COATING | PROCESS | Ni | W | Pt | DESCRIPTION |
| Normal | a) 6 μm Pt Plate | — | — | — | |
| Standard | b) Pt diffusion | — | — | — | |
| PtNiAl, Thin | c) Aluminizing | 31.9 | 1.0 | 32.5 | Dual phase additive layer structure |
| | d) Post coat diffusion | 46.1 | 1.0 | 24.2 | Single phase pt/NiAl additive layer |
| Thick PtNiAl | a) 9 μm Pt plate | — | — | — | |
| coating 'A' | b) Pt diffusion | — | — | — | Dual/multiphase microstructure |
| | c) Aluminizing | 33.42 | 0 | 34.62 | Dual/multiphase additive layer |

TABLE I-continued

| | | | | | |
|---|---|---|---|---|---|
| | d) post coating diffusion | 42.95 | 0 | 31.15 | Single Phase Additive Pt/Ni Aluminide |
| Thick, PtNiAl coating 'B' | a) 12 μm Pt plate | — | — | — | |
| | b) Pt diffusion | — | — | — | Dual/Multiphase microstructure |
| | c) Aluminizing | 28.8 | 1.0 | 37.2 | Dual/Multiphase Additive layer |
| | d) post coating diffusion | 39.7 | 0.22 | 34.2 | Quasi-single phase |
| Thick, PtNiAl coating 'C' | a) 12 μm Pt plate | — | — | — | |
| | b) Pt diffusion | — | — | — | |
| | c) First cycle Aluminizing | 36.1 | 0 | 31.2 | |
| | d) Post coat diffusion | 44.6 | 0 | 28.5 | Single phase beta PtNiAl |
| | e) Two more aluminization cycles and heat treat cycles | 40.8 | 0.24 | 26.9 | Quasi-single Phase Type, comprising beta PtNiAl additive layer with a zone of finely dispersed $PtAl_2$ precipitates. |

EXAMPLE 1

Figure 6:
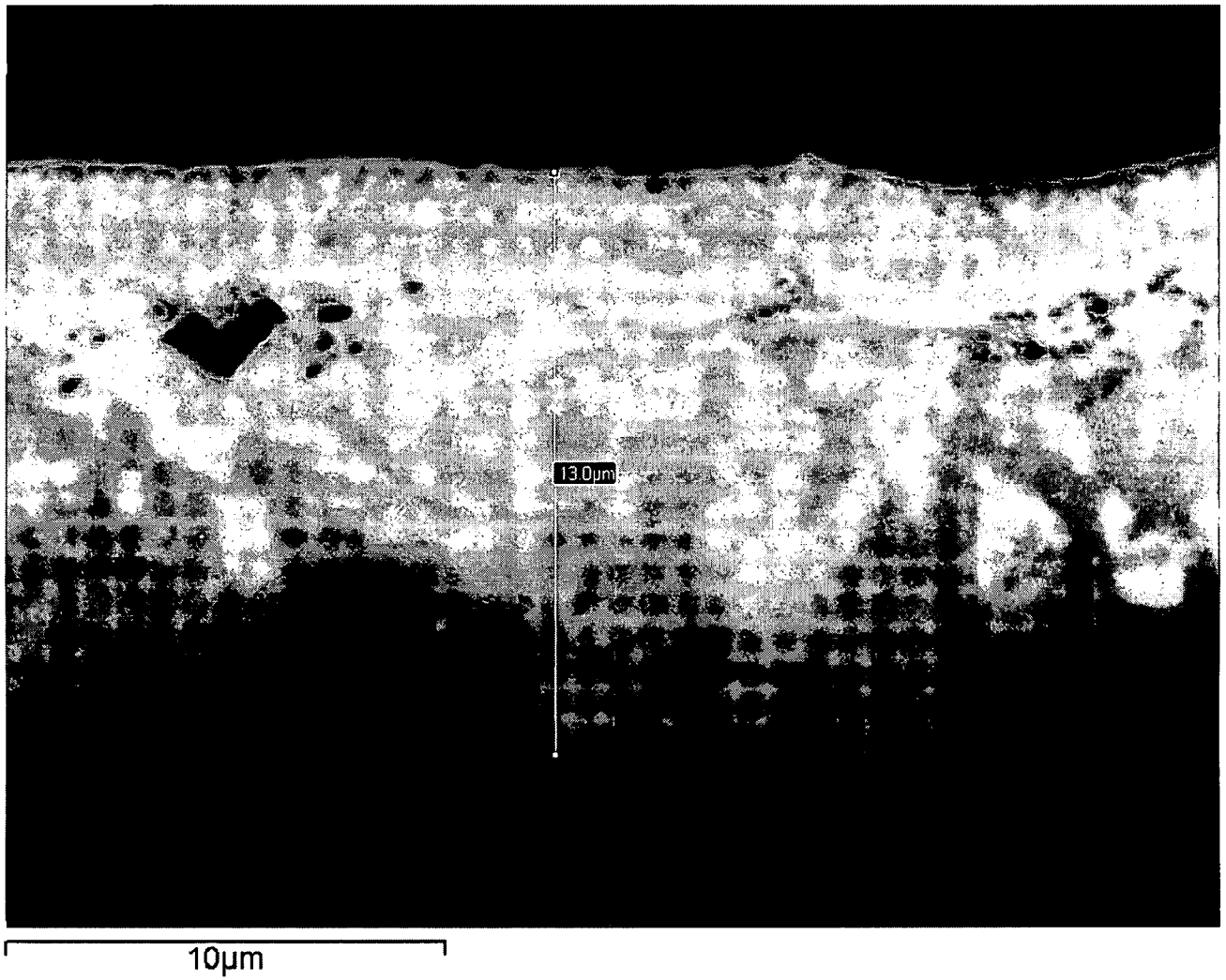
FIG. 6 is a representation of a substrate after a platinum diffusion step of a process for producing a thin single phase beta platinum nickel aluminide coating thereon.
Figure 7:
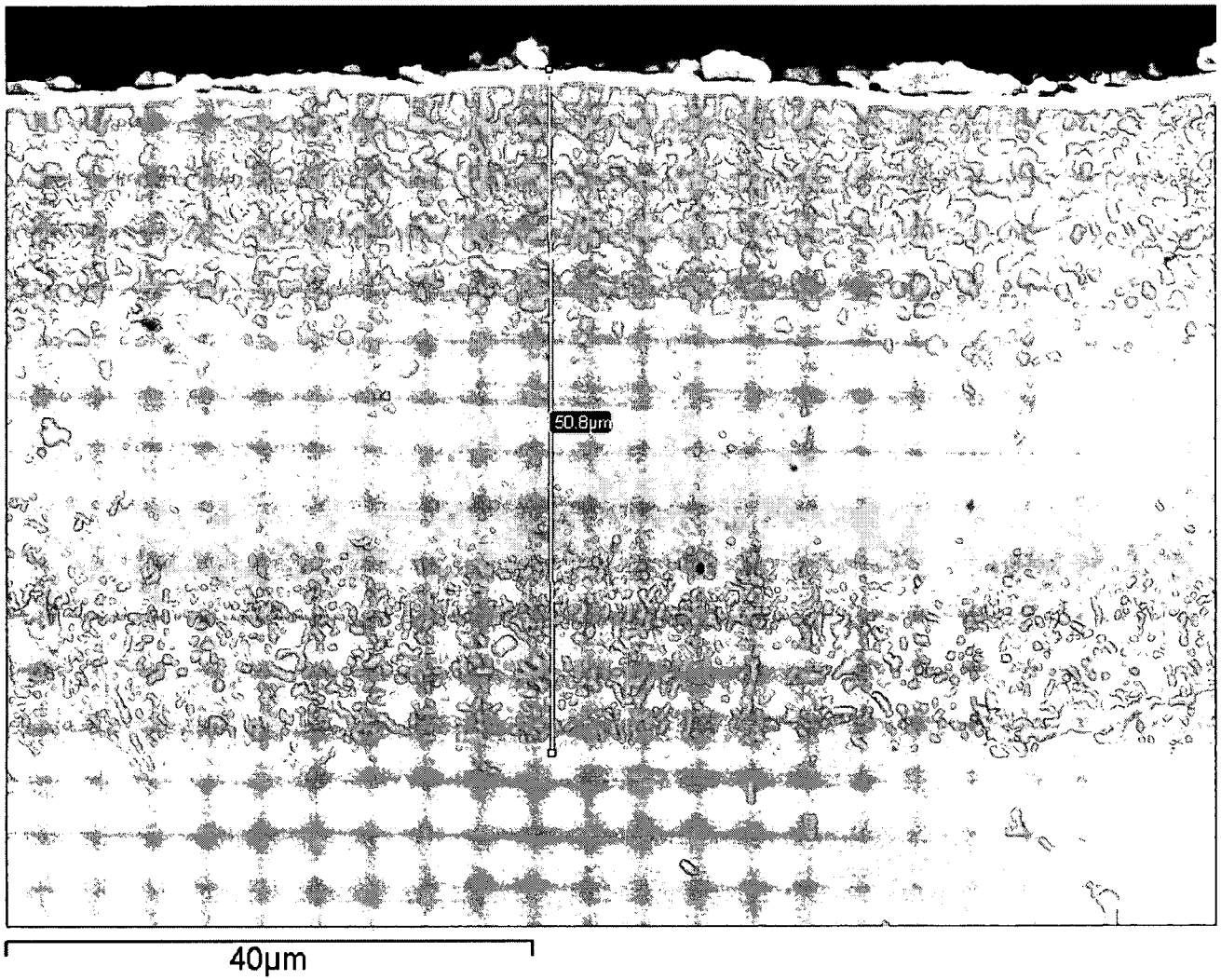
FIG. 7 is a representation of the substrate shown in FIG. 6 after an aluminization step of the process for producing the thin single phase beta platinum nickel aluminide coating thereon.
Figure 8:
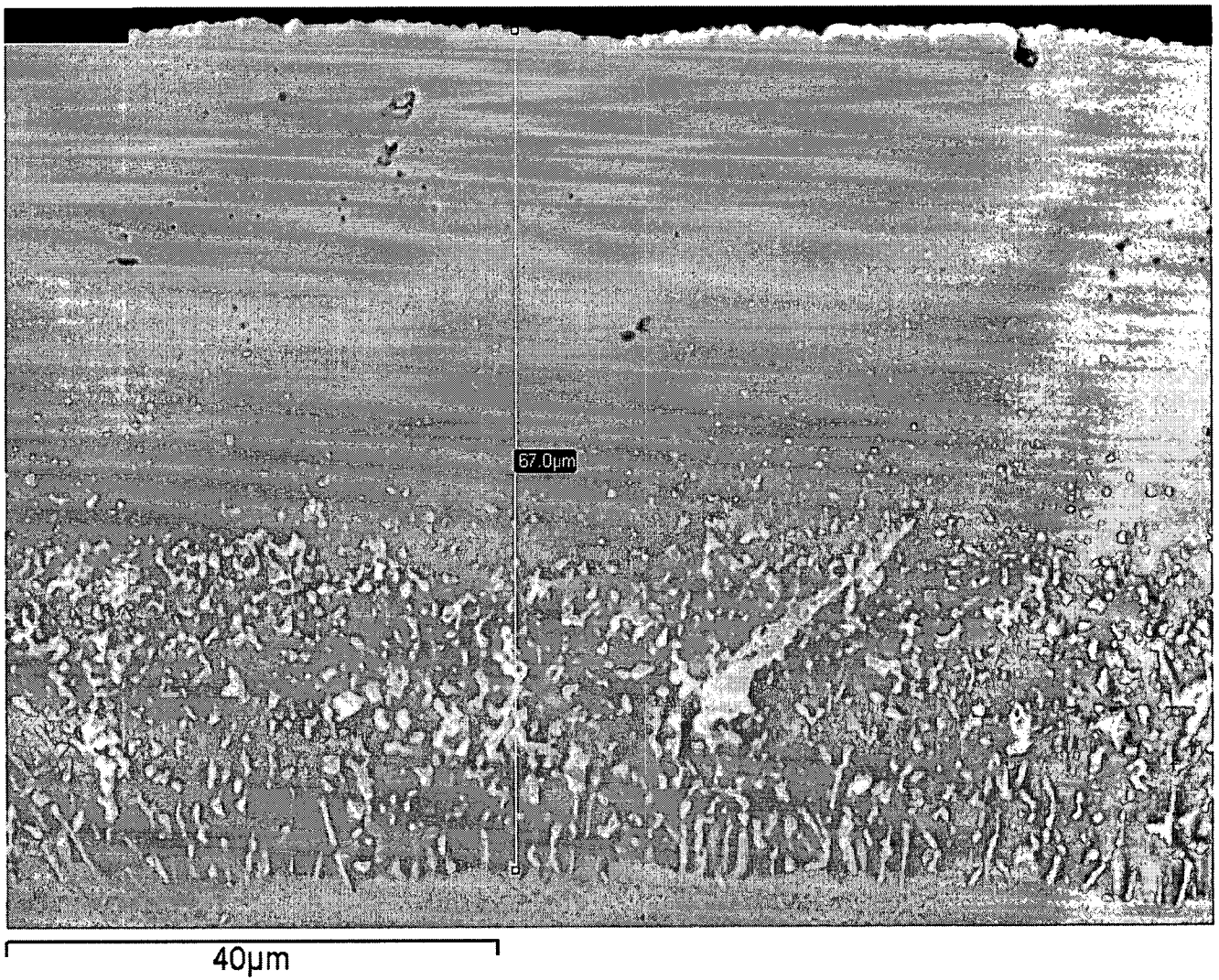
FIG. 8 is a representation of the substrate after a final diffusion step of the process for producing the thin single phase beta platinum nickel aluminide coating thereon.

As briefly mentioned above, in one example, a thin single phase beta platinum nickel aluminide coating was formed. First, about 6 μm Pt was electroplated onto a nickel alloy substrate. Then, plated Pt was diffused into the substrate by subjecting the substrate to a temperature of about 1900° F. (about 1040° C.) for about 90 minutes in a vacuum to form a diffusion zone, as shown in FIG. 6. As shown in FIG. 7, the diffusion zone was aluminized under a "low activity" process at a temperature of about 1975° F. (about 1080° C.) for about 85 minutes in a vacuum with a partial pressure of argon gas. Then, the aluminized diffusion zone was heat treated at a temperature of about 1950° F. (about 1065° C.) for about 3 hours to yield the thin single phase beta platinum nickel aluminide coating shown in FIG. 8.

The results obtained from the method are presented in Table I above under the "Normal Standard Thin Platinum Nickel Aluminide" coating. Preferably, heat treatment continues until the single phase additive layer contains Pt in a concentration of about 20% by weight and Al in a concentration of about 20% by weight. In some instances, the single phase additive layer may include Pt at a concentration of up to about 40% by weight.

In order to produce thick platinum aluminide coatings, studies were carried-out on MarM247 superalloy substrates. Varying processing conditions of 6 to 12 μm Pt plating, 1900° F. to 2025° F. (about 1040° C. to about 1110° C.) temperature range for 90 minutes to 240 minutes duration for Pt diffusion, single and multiple aluminization cycle of 1975° F. (about 1080° C.) for 85 minutes, and post coat diffusion heat treatment in the 1950° F. to 2025° F. (about 1065° C. to about 1110° C.) temperature range for 3 to 4 hours duration were used.

EXAMPLE 2

Figure 9:
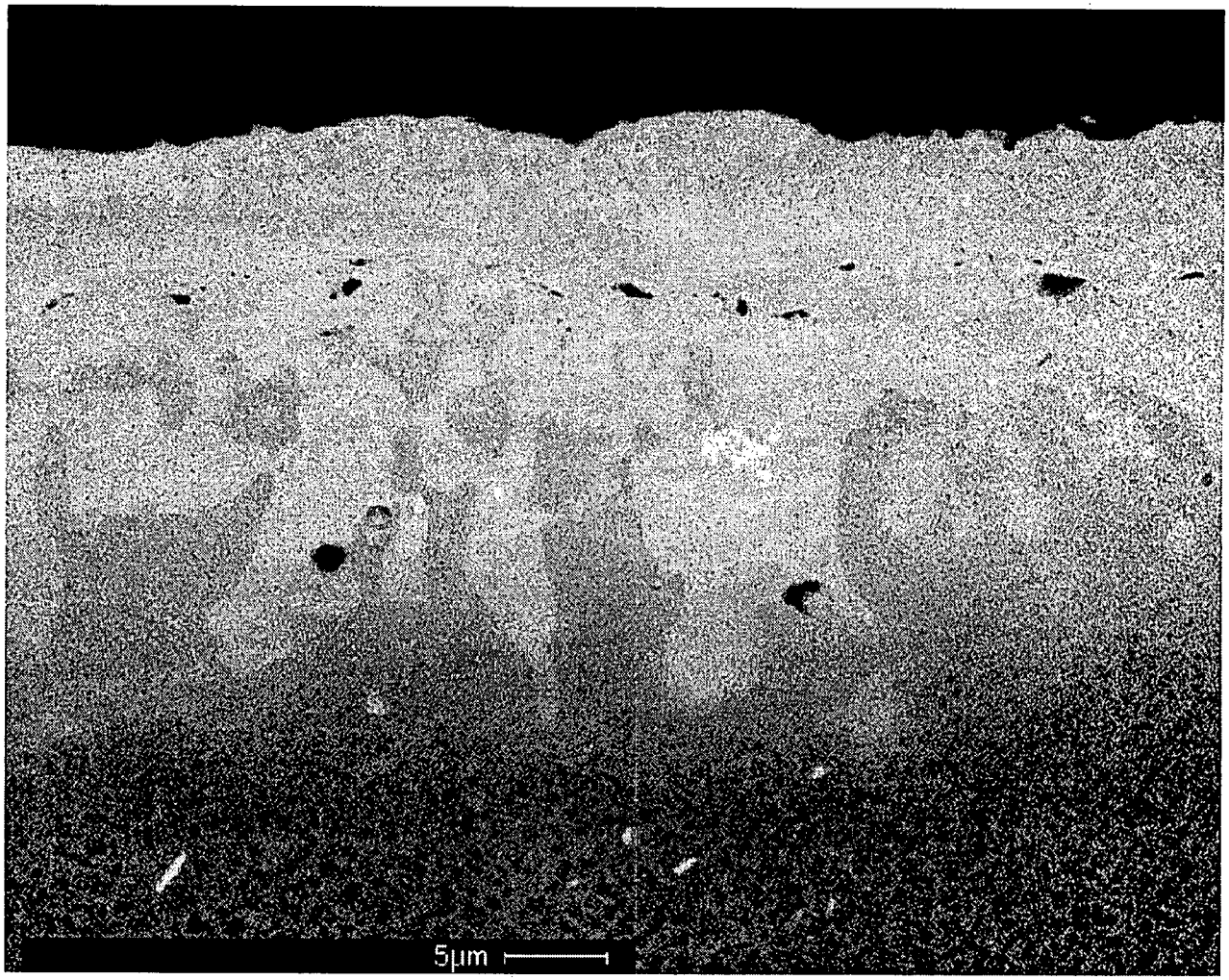
FIG. 9 is a representation of a substrate after a platinum diffusion step of a process for producing a thick single phase beta platinum nickel aluminide coating ("Coating A of Table I") thereon.
Figure 10:
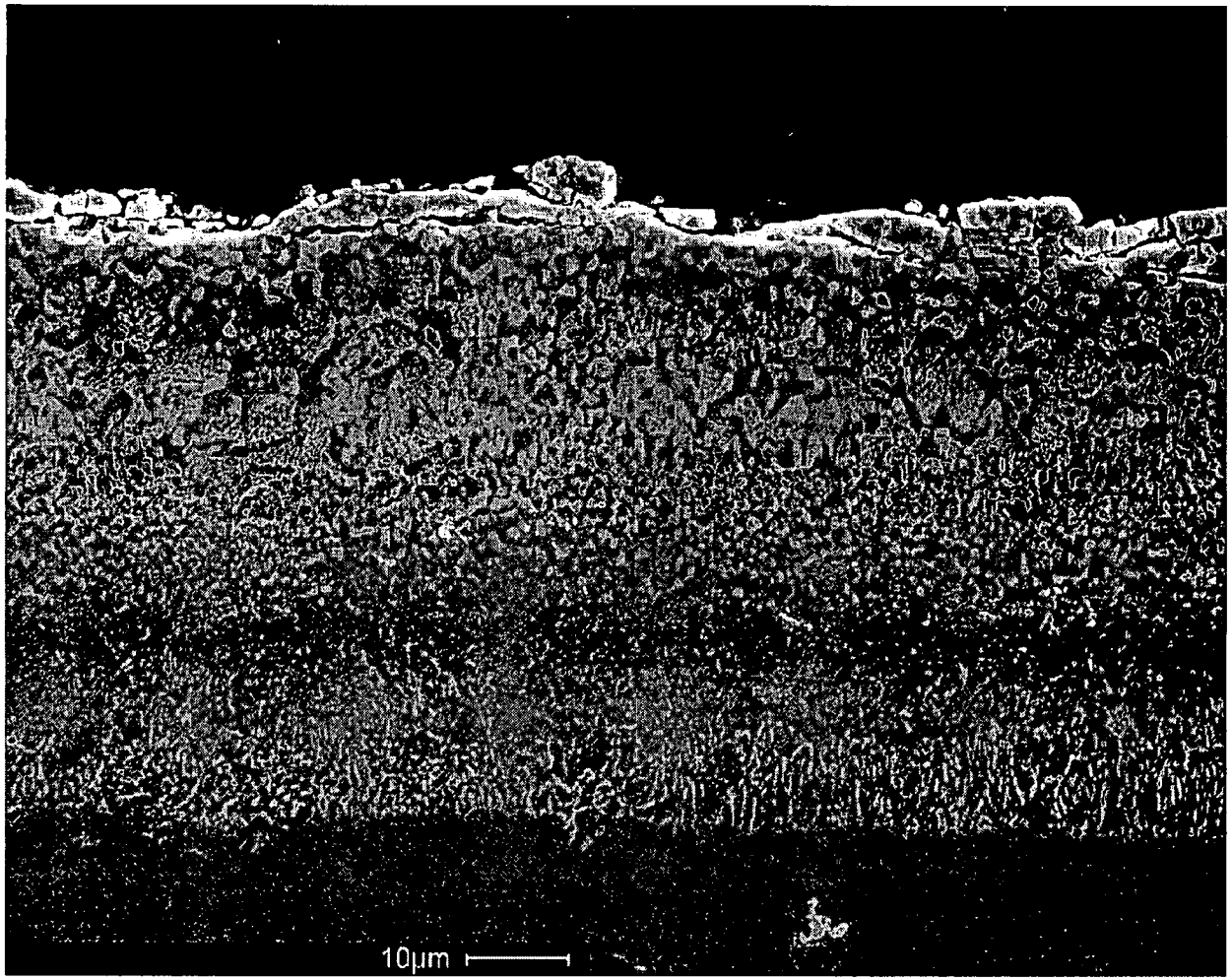
FIG. 10 is a representation of the substrate shown in FIG. 9 after an aluminization step of the process for producing a thick single phase beta platinum nickel aluminide coating ("Coating A of Table I") thereon.
Figure 11:
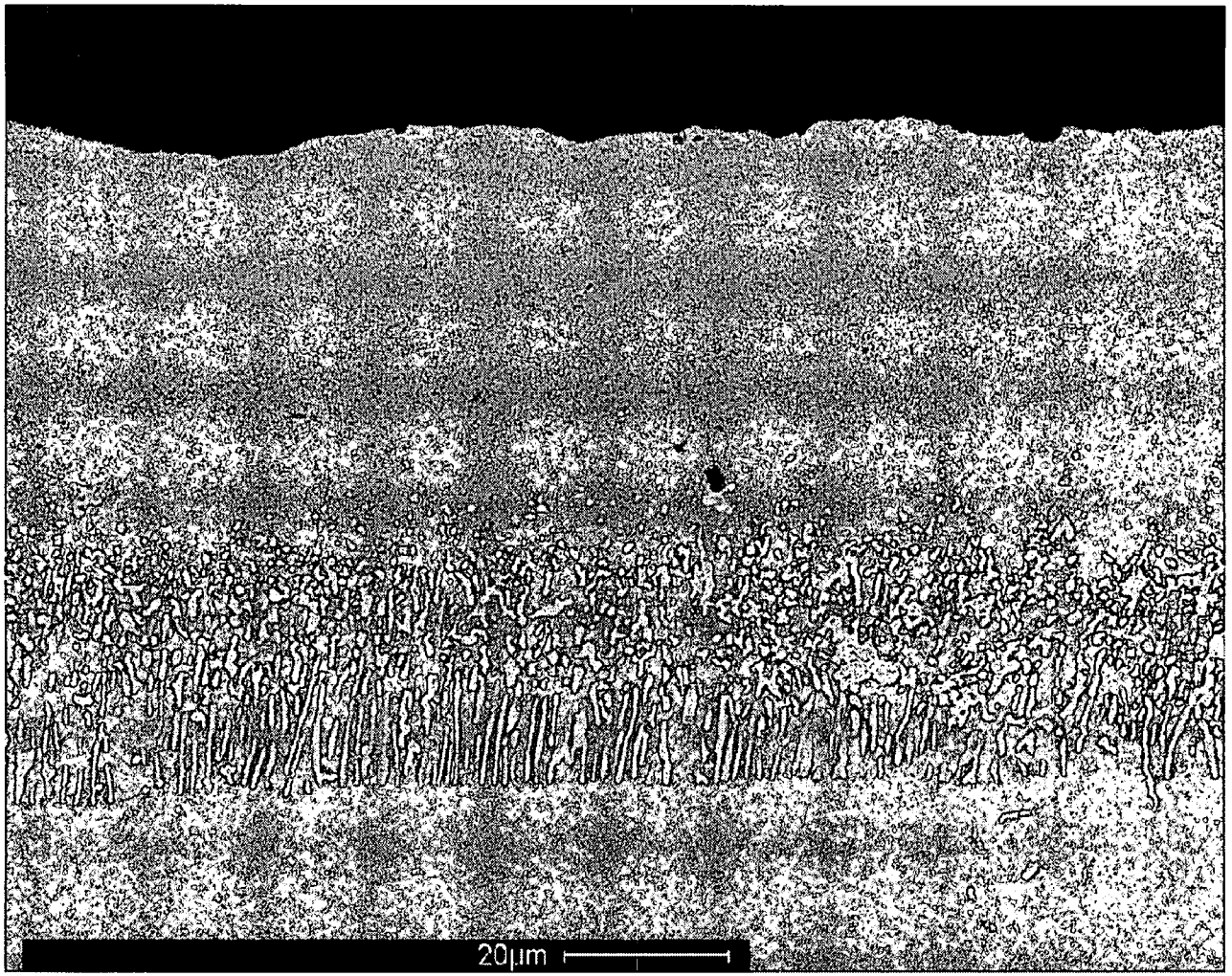
FIG. 11 is a representation of the substrate shown in FIG. 10 after a final diffusion step for producing a thick single phase beta platinum nickel aluminide coating ("Coating A of Table I") thereon.

In one particular example, summarized in Table I under Coating 'A', the thick platinum aluminide coating was developed by initially electroplating 9 μm Pt onto a MarM247 superalloy substrate. Pt diffusion occurred at 2000° F. (about 1090° C.) for 4 hours in a vacuum, as shown in FIG. 9. The diffusion zone was aluminized under a "low activity" process at a temperature of about 1975° F. (about 1080° C.) for about 85 minutes in a vacuum with a partial pressure of argon gas. The resulting structure is shown in FIG. 10. The aluminized diffusion zone was heat treated at a temperature of about 2000° F. (about 1090° C.) for about 4 hours. The final coating structure as represented in FIG. 11 was about 75 μm in total thickness and exhibited about 45 μm of additive layer and comprised single phase beta platinum nickel aluminide.

It will be appreciated that an important consideration for the effective coating performance is the ductility exhibited by the coating microstructures. The multi phase additive layer microstructures such as those often produced just after aluminization, for example after step c under Coating A in Table I, tends to exhibit brittle behavior. This aspect is illustrated with reference to the aluminized microstructure in FIG. 10 and Table II below.

TABLE II

| Location | Knoop Hardness No. (After Aluminization) |
|---|---|
| Multi-phase (near the surface) | 1220 |
| Between Top Layer and Diffusion Zone | 1291 |
| Diffusion Zone | 1176 |
| Substrate | 658 |

Figure 12:
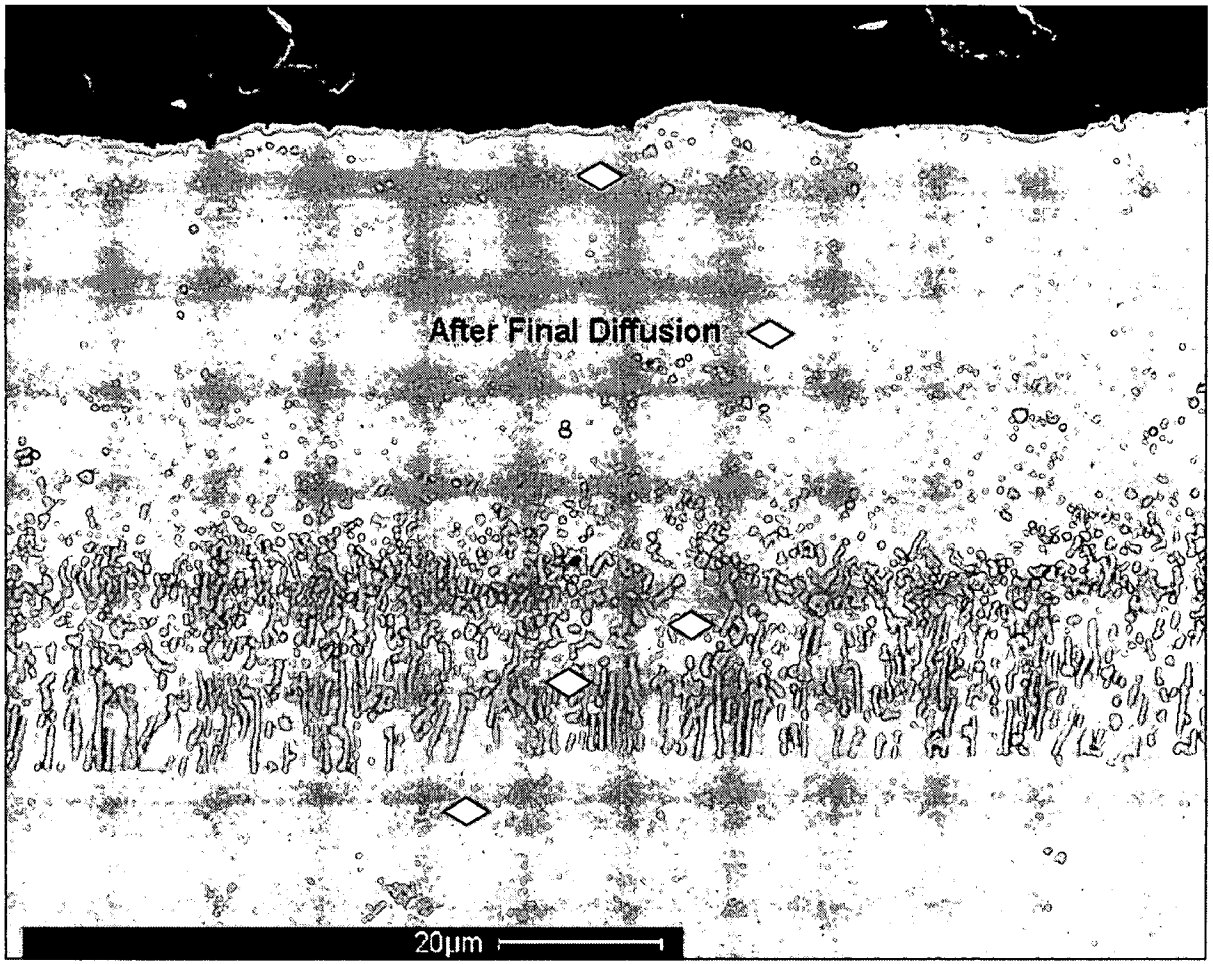
FIG. 12 is a representation of 10 gm load Knoop Hardness evaluation of the Coating A depicted in FIG. 11.

Table II shows that the aluminized additive layer (generally comprised of PtAl2 and platinum nickel aluminide phases) exhibit high Knoop Hardness readings of over 1200 when compared to the values of about 650 for the MarM247 substrate material. The diffusion zone formed from the substrate alloy also shows such higher hardness values due to the enrichment of carbide phases that accompanies with the outward diffusion of nickel. However, as depicted in FIG. 12 and in Table III below, after post aluminization diffusion heat treatment the single phase beta platinum nickel aluminide additive layer exhibits reduced hardness values of around 830 which is closer to the hardness of substrate material. The microhardness readings for the additive layer which contained the finely dispersed precipitates noted with the quasi-single phase structure were in the range of 668 to 792. Therefore, it can be inferred that the coating microstructures of the present invention would exhibit needed toughness requirements for the encountered operational conditions.

TABLE III

| Location | Knoop Hardness No,. (After Aluminization) |
|---|---|
| Additive layer (near the surface) | 792 |
| Additive Layer (mid thickness) | 868 |
| Additive Layer (just above diffusion zone) | 941 |
| Diffusion Zone | 1022 |
| Substrate | 624 |

EXAMPLE 3

A thick platinum nickel aluminide coating of about 86 μm in total thickness was developed. In this example, as depicted in Table I under Coating B, 12 μm Pt was first plated onto a MarM247 superalloy substrate. Then, the substrate was subjected to a Pt diffusion process that occurred at about 2025° F. (about 1110° C.) for about 4 hours in a vacuum. An aluminization cycle was performed on the substrate at a temperature of about 1975° F. (about 1080° C.) for about 85 minutes in a vacuum with a partial pressure of Ar gas. Next, the substrate was exposed post coating diffusion at 2025° F. (about 1100° C.) for about 4 hours. The resulting coating microstructure is represented in FIG. 2.

In this embodiment, the diffusion zone was about 30 μm from the substrate. The additive layer above the diffusion zone had a thickness of about 56 μm. However, at about 20 μm below the top surface of the coating (of the additive layer as well), a zone having a thickness of about 8 μm exhibiting a very fine dispersion of sub-micron sized secondary precipitates (presumably $PtAl_2$) was detected in the beta platinum nickel aluminide. This zone of precipitated secondary precipitates in the single phase additive layer was designated as a "quasi-single phase platinum nickel aluminide" microstructure. The quasi-single phase structures are akin to the single phase platinum nickel aluminides (such as the ones shown in FIGS. 8 and 11) and thus may provide additional advantages.

EXAMPLE 4

Figure 13:
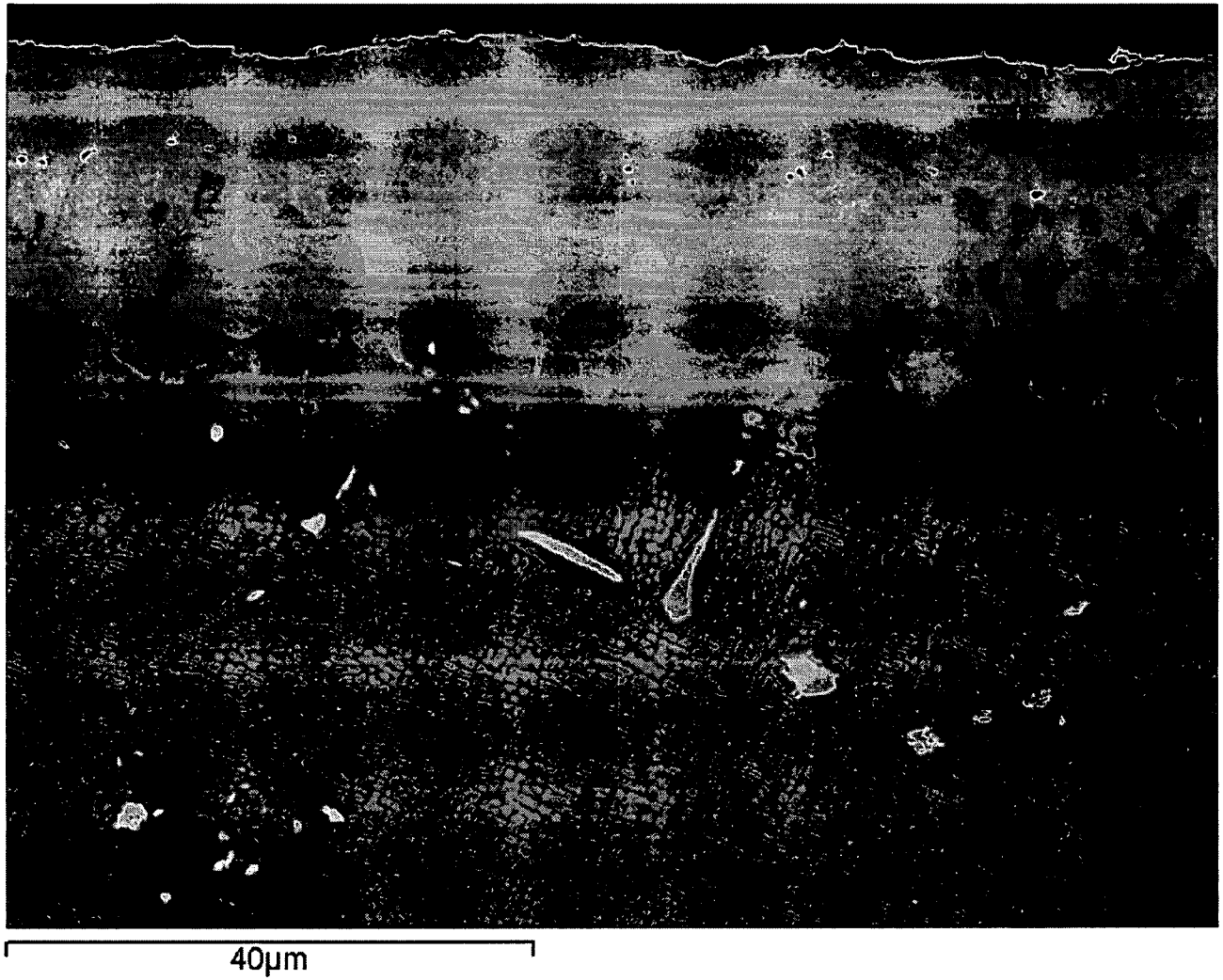
FIG. 13 is a representation of a substrate after a platinum diffusion step of a process for producing a thick single phase beta platinum nickel aluminide coating using 12 μm Pt plating ("Coating C of Table I")
Figure 14:
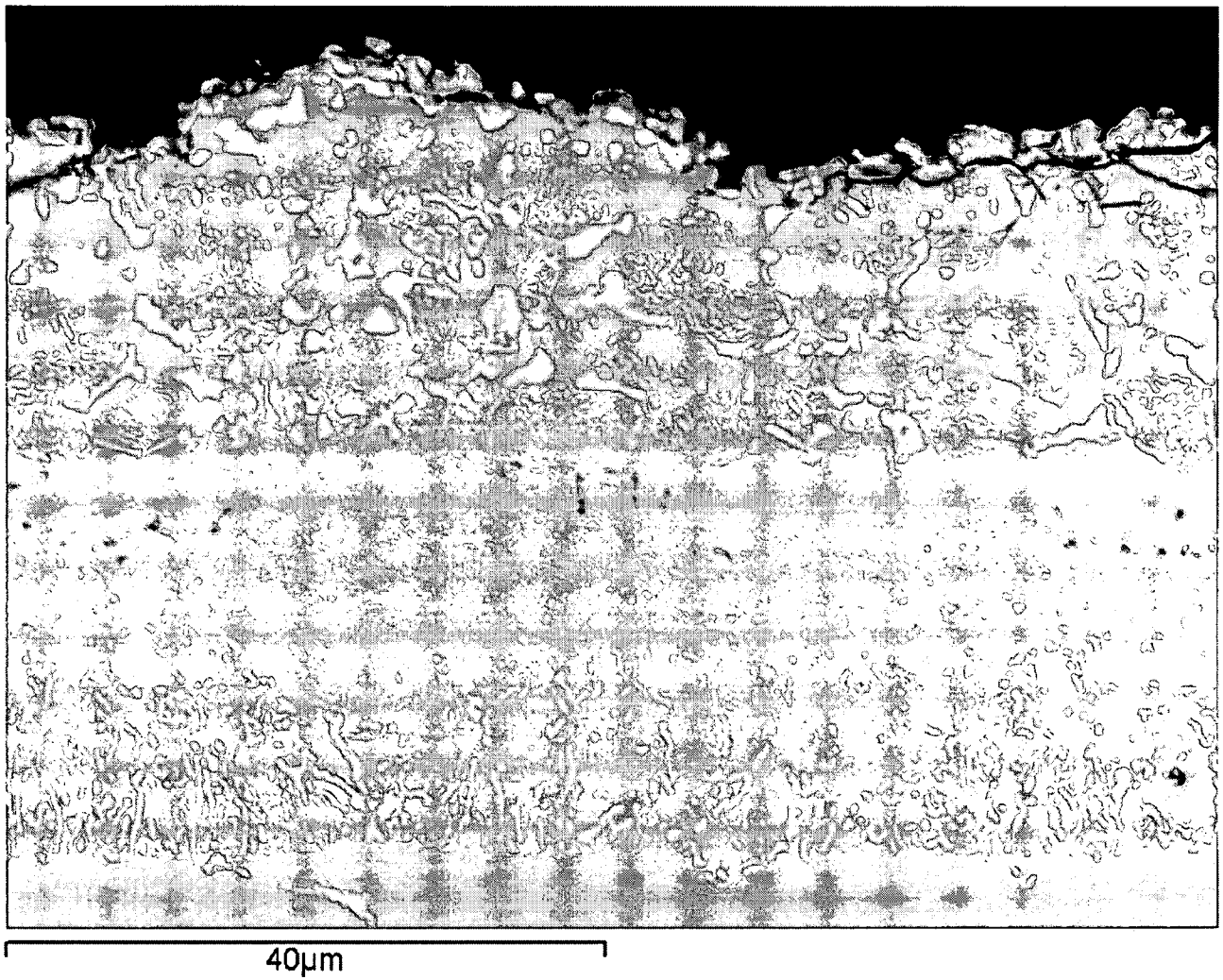
FIG. 14 is a representation of the substrate shown in FIG. 13 after a first aluminization step of the process for producing the thick single phase beta platinum nickel aluminide coating ("Coating C of Table I")
Figure 15:
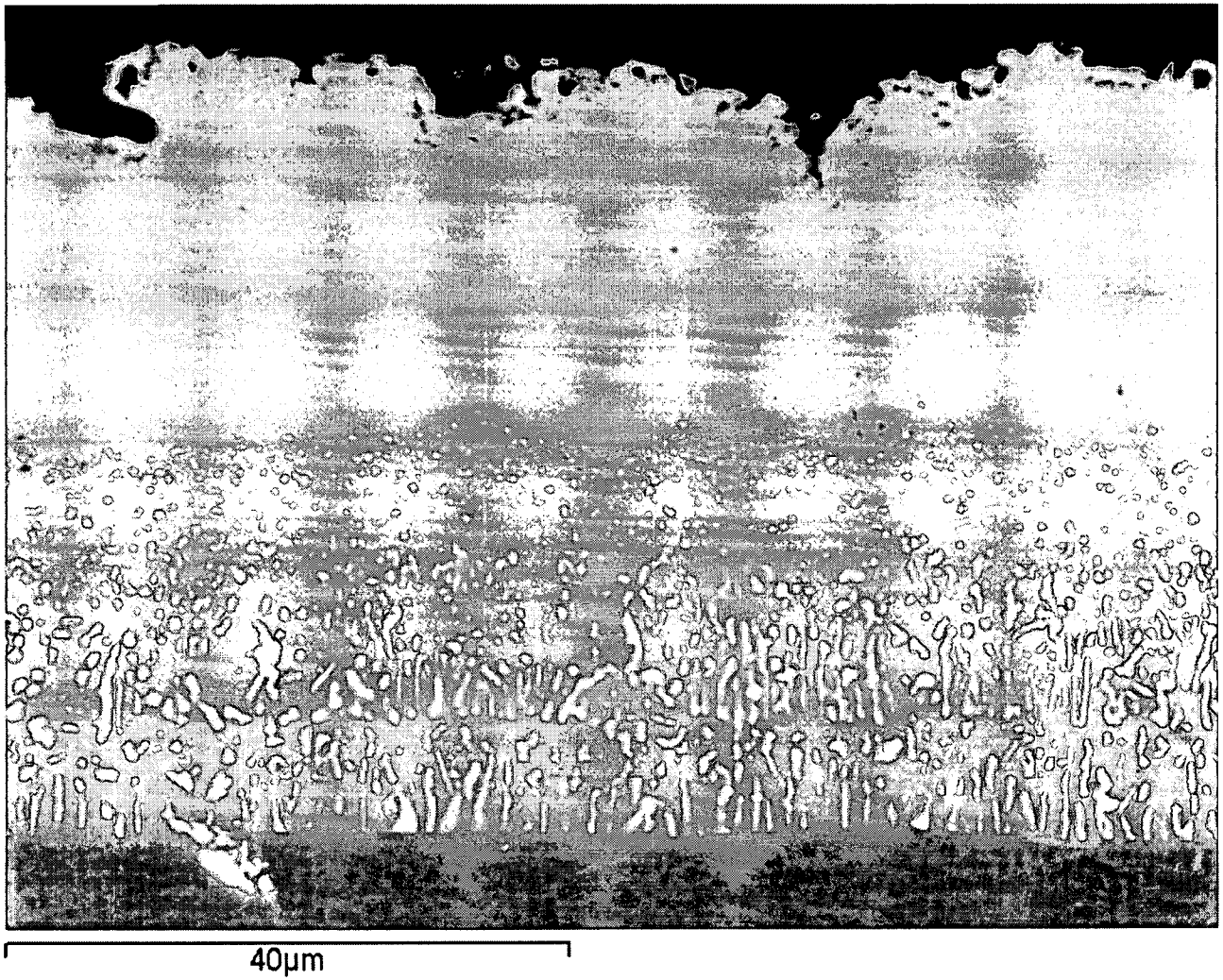
FIG. 15 is a representation of the substrate shown in FIG. 14 after a first post coat heat treat diffusion of the process for producing the thick single phase beta platinum nickel aluminide coating ("Coating C of Table I")
Figure 16:
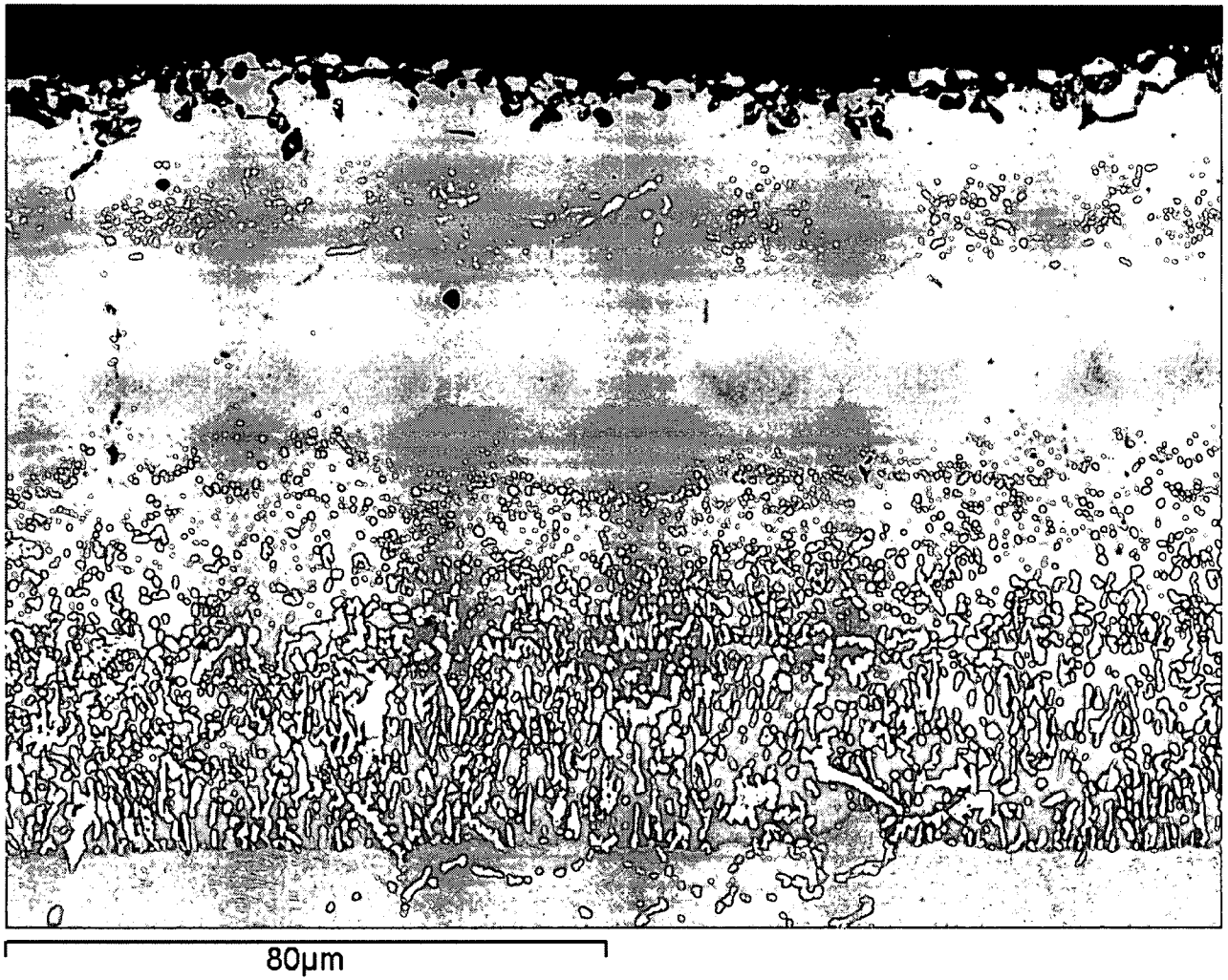
FIG. 16 is a representation of the substrate shown in FIG. 15 after three aluminization and post coat heat treat diffusion cycles of the process for producing the thick single phase beta platinum nickel aluminide coating ("Coating C of Table I").

Thick platinum aluminides may alternatively be produced by providing sufficient Pt in the initial step of electroplating and then utilizing multiple aluminization and post coat diffusion heat treatments. An example of this processing methodology and the noted coating results is presented in Table I under Coating C. In this case, an initial thickness of 12 μm Pt was plated on a MarM247 substrate and a total of three aluminization and post coat diffusion heat treat cycles were used. Specifically, after Pt plating, the Pt diffusion step occurred at a temperature of about 1975° F. (about 1080° C.) for about 4 hours in a vacuum. A representation of the resulting microstructure is shown in FIG. 13. Then, a first aluminization cycle was performed at a temperature of 1975° F. (about 1080° C.) for about 85 minutes in a vacuum with partial pressure and Ar gas, the result of which is shown in FIG. 14. Next, the substrate was exposed to a post coat diffusion process at a temperature of about 1950° F. (about 1065° C.) for about 3 hours. A single phase coating structure was obtained as shown in FIG. 15. However, the coating was thin (about 55 μm); thus, to produce a thicker platinum aluminide coating, two more aluminization and post coat diffusion heat treat cycles were employed. As shown in FIG. 16, the resulting coating thickness was over 100 μm. The microstructure after the multiple aluminization and post coat diffusion heat treats (a total of three repeat cycles) was quasi-single phase.

Although the distinguishing feature of the quasi-single phase from the single phase platinum nickel aluminide coatings is the presence of the platinum aluminide zone 108 in the additive layer of the thick platinum aluminide coating, a pure single phase coating without a platinum aluminide zone 108 can be produced through changes in the production process parameters. For example, as mentioned above, by using the 9 μm Pt plating and a single aluminization cycle followed by a single post heat treat cycle as outlined for Coating A in Table I, it is feasible to produce a single phase structure without the zone 108 in the additive layer. Alternatively, reducing the Al pick-up and/or increasing the Ni diffusion during step (e) in the process of forming Coating C can also eliminate the $PtAl_2$ zone in the additive layer and may thus produce a thick single phase coating. As an example, utilizing a temperature of 1950° F. (about 1065° C.) and duration of 60 minutes for aluminization and a temperature of 2000° F. (about 1090° C.) for a duration of 4 hours for diffusion for post coat heat treatment during the multiple aluminization and heat treat cycles may be suitable for producing a thick single phase coating.

Moreover, although the use of 12 μm thick Pt plating is illustrated, it should be apparent to those skilled in the art that Pt thickness in the range of 6 to 15 μm or above can be advantageously utilized as long as the desired Pt levels are achieved in the final coating. The cost of coating, of course would necessarily go up with increased utilization of Pt thickness. Hence, there would be a need to exercise a balance and an optimization of the plated Pt thickness.

Since Pt is effective in limiting the diffusion of many deleterious alloying elements from the superalloy substrate, a thicker Pt plated layer may be desirable for developing thick platinum aluminides. On the other hand, under the processing conditions described above, many desirable substrate alloying elements such as Hf, Ta, Zr, Y etc., may not be incorporated into the coating due to these limitations. Therefore, controlled amounts of desired active elements, such as Hf, Si, Ta, Zr, and Y, may be added to the coating, either alone or synergistically after and/or during Platinum diffusion with the substrate in order to significantly improve the high temperature protective behavior of the platinum nickel aluminide coatings.

There has now been provided a coating and a method for forming the coating on hot section components, where the coating protects the components from degradation due to corrosion, oxidation, sulfidation, thermal fatigue, and other hazards. The coating is a substantially single phase platinum nickel aluminide coating having a total coating thickness of greater than about 75 μm and referred to as Thick Platinum Aluminide coating.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A method for forming a thick quasi-single phase platinum nickel aluminide coating over a nickel-based superalloy substrate, the method comprising the steps of:

forming a metal layer over a surface of the nickel-based superalloy substrate, the metal layer comprising platinum;

growing a diffusion zone from the metal layer and the nickel-based superalloy substrate, the diffusion zone comprising a platinum nickel alloy; and subjecting the platinum nickel alloy to a first aluminization cycle by depositing aluminum over the platinum nickel alloy and performing a first heat treatment diffusion cycle thereon to form a single phase beta platinum nickel aluminide layer; and performing a second aluminization cycle by depositing aluminum over the single phase beta platinum nickel aluminide layer and performing a second heat treatment diffusion cycle thereon to transform the single phase beta platinum nickel aluminide layer into the thick quasi-single phase platinum nickel aluminide coating comprising a beta platinum nickel aluminide additive layer having a zone including $PtAl_2$ precipitates dispersed therein.

2. The method of claim 1, wherein the nickel-based superalloy substrate comprises NiCrAlY.

3. The method of claim 1, wherein the step of forming the metal layer comprises electroplating the metal layer on the surface of the nickel-based superalloy substrate.

4. The method of claim 1, wherein the step of growing the diffusion zone comprises heating the metal layer to between about 1025° C. and about 1150° C.

5. The method of claim 1, wherein the step of subjecting the platinum nickel alloy further comprises performing the first heat treatment diffusion cycle by heating to a temperature in the range of between about 1025° C. and about 1150° C.

6. The method of claim 1, wherein the step of subjecting the platinum nickel alloy further comprises depositing aluminum by chemical vapor deposition under low to intermediate activity.

7. The method of claim 1, wherein at least one cycle of the first aluminization cycle and the second aluminization cycle is an out-of-pack vapor phase process.

8. The method of claim 1, wherein at least one cycle of the first aluminization cycle and the second aluminization cycle is an in-pack process.

9. The method of claim 1, wherein the coating has a surface and the method further comprises the step of modifying the coating surface to incorporate active elements therein to improve coating performance, wherein the active elements comprise at least one constituent selected from the group consisting of Hf, Si, Ta, Zr, and Y.

10. A method for forming a quasi-single phase platinum nickel aluminide coating over a NiCrAlY substrate, the method comprising the steps of:

forming a metal layer over a surface of the NiCrAlY substrate, the metal layer comprising platinum;

growing a diffusion zone from the metal layer and the NiCrAlY substrate, the diffusion zone comprising a platinum nickel alloy; and subjecting the platinum nickel alloy to a first aluminization cycle by depositing aluminum over the platinum nickel alloy and performing a first heat treatment diffusion cycle thereon to form a single phase beta platinum nickel aluminide layer; and performing a second aluminization cycle by depositing aluminum over the single phase beta platinum nickel aluminide layer and performing a second heat treatment diffusion cycle thereon to transform the single phase beta platinum nickel aluminide layer into the quasi-single phase platinum nickel aluminide coating comprising a beta platinum nickel aluminide additive layer having a zone including $PtAl_2$ precipitates dispersed therein.

11. The method of claim 10, wherein the step of subjecting the platinum nickel alloy further comprises depositing aluminum by chemical vapor deposition.

12. The method of claim 10, wherein at least one cycle of the first aluminization cycle and the second aluminization cycle is an out-of-pack vapor phase process.

13. The method of claim 10, wherein at least one cycle of the first aluminization cycle and the second aluminization cycle is an in-pack process.

14. The method of claim 10, wherein the coating has a surface and the method further comprises the step of modifying the coating surface to incorporate active elements therein to improve coating performance, wherein the active elements comprise at least one constituent selected from the group consisting of Hf, Si, Ta, Zr, and Y.

* * * * *